US009932805B2

(12) United States Patent
Kuykendall et al.

(10) Patent No.: US 9,932,805 B2
(45) Date of Patent: Apr. 3, 2018

(54) PAD-TYPE PLUNGER

(71) Applicant: EPIC LIFT SYSTEMS LLC, Fort Worth, TX (US)

(72) Inventors: Schuyler Kuykendall, Granbury, TX (US); James Allen Jefferies, Granbury, TX (US)

(73) Assignee: EPIC LIFT SYSTEMS LLC, Fort Worth, TX (US)

( * ) Notice: Subject to any disclaimer, the term of this patent is extended or adjusted under 35 U.S.C. 154(b) by 247 days.

(21) Appl. No.: 14/854,186

(22) Filed: Sep. 15, 2015

(65) Prior Publication Data

US 2016/0115769 A1 Apr. 28, 2016

Related U.S. Application Data

(60) Provisional application No. 62/067,114, filed on Oct. 22, 2014.

(51) Int. Cl.
*E21B 43/12* (2006.01)

(52) U.S. Cl.
CPC ..... *E21B 43/121* (2013.01)

(58) Field of Classification Search
CPC ..... F04B 47/12
USPC ..... 417/59, 60; 166/68, 105, 106
See application file for complete search history.

(56) References Cited

U.S. PATENT DOCUMENTS

| | | | | |
|---|---|---|---|---|
| 5,427,504 | A | 6/1995 | Dinning et al. | |
| 6,591,737 | B2 | 7/2003 | Giacomino | |
| 7,093,652 | B2 * | 8/2006 | Gray | E21B 43/121 166/101 |
| 2015/0053427 | A1 * | 2/2015 | Suttipisetchart | E21B 43/121 166/382 |

OTHER PUBLICATIONS

Author Unknown, Plunger-Lift Systems, Ferguson Beauregard™, Plunger-Lift Brochure, no date available, pp. 1-4.

* cited by examiner

*Primary Examiner* — Sean D Andrish
(74) *Attorney, Agent, or Firm* — MH2 Technology Law Group, LLP

(57) ABSTRACT

A downhole tool, e.g., a plunger, and a method for manufacturing a plunger. The downhole tool includes a mandrel including a flow-restriction recess, and a plurality of sealing pads configured to be disposed around the mandrel, biased radially-outward therefrom, and interlocked with one another. Each of the plurality of sealing pads includes a flow-restriction tab having an axial thickness that varies as proceeding circumferentially around the mandrel. The flow-restriction tab of each of the plurality of sealing pads is configured to be disposed in the flow-restriction recess when the plurality of sealing pads are disposed on the mandrel.

20 Claims, 7 Drawing Sheets

PAD-TYPE PLUNGER

CROSS-REFERENCE TO RELATED APPLICATIONS

This application claims priority to U.S. Provisional Patent Application having Ser. No. 62/067,114, which was filed on Oct. 22, 2014 and is incorporated herein by reference in its entirety.

BACKGROUND

Plungers are employed to facilitate removal of gas from oilfield wells, addressing challenges incurred by "liquid loading." In general, a well may produce liquid and gaseous elements. When gas flow rates are high, the gas carries the liquid out of the well as the gas rises. However, as well pressure decreases, the flowrate of the gas decreases to a point below which the gas fails to carry the heavier liquids to the surface. The liquids thus fall back to the bottom of the well, exerting back-pressure on the formation, and thereby loading the well.

Plungers alleviate such loading by assisting in removing liquid and gas from the well, e.g., in situations where the ratio of liquid to gas is high. In operation, the plunger descends to the bottom of the well, where the loading fluid is picked up by the plunger and is brought to the surface as the plunger ascends in the well. The plunger may also keep the production tubing free of paraffin, salt, or scale build-up.

One type of plunger is known as a "pad-type" plunger. Generally, these types of plungers include one or more sets of radially expandable sealing pads. The sealing pads may be biased radially-outwards, and may thus expand to engage the production tubing, and form a partial seal therewith. However, one issue with such plungers is that fluids may be able to flow past the plunger in the space radially between the pads and the center body or "mandrel" to which the pads are attached, and/or in spaces between the expandable pads. Furthermore, the pads are typically cast-formed, which may also allow for fluid flow past the plunger, between the pads and the production tubing. As such, the seal may be far from fluid tight. While some fluid flow past the plunger may be desired, e.g., to hasten descent, it may be desired to minimize the flow rate past the plunger, e.g., to maximize production and increase efficiency.

SUMMARY

Embodiments of the disclosure may provide a downhole tool. The downhole tool includes a mandrel including a flow-restriction recess, and a plurality of sealing pads configured to be disposed around the mandrel, biased radially-outward therefrom, and interlocked with one another. Each of the plurality of sealing pads includes a flow-restriction tab having an axial thickness that varies as proceeding circumferentially around the mandrel, when the plurality of sealing pads are disposed around the mandrel. The flow-restriction tab of each of the plurality of sealing pads is configured to be disposed in the flow-restriction recess when the plurality of sealing pads are disposed on the mandrel.

Embodiments of the disclosure may also provide a plunger. The plunger includes a mandrel including first and second annular partition walls. The first and second partition walls are spaced axially apart such that a first pad-receiving section is defined therebetween. A first flow-restriction recess is defined in the mandrel at the pad-receiving section, the first flow-restriction extending at least partially around the mandrel. The plunger also includes a first sealing pad including a first flow-restriction tab. The first flow-restriction tab has a first portion defining a first axial thickness and a second portion defining a second axial thickness. The first axial thickness is greater than the second axial thickness. The first portion is circumferentially adjacent to the second portion. The first sealing pad is configured to be disposed in the first pad-receiving section. The plunger also includes a second sealing pad including a second flow-restriction tab, the second flow-restriction tab having a first portion defining a first axial thickness and a second portion defining a second axial thickness. The first axial thickness of the second flow-restriction tab is greater than the second axial thickness thereof. The first portion of second flow-restriction tab is circumferentially adjacent to the second portion of the second flow-restriction tab. The second sealing pad is configured to be disposed in the first pad-receiving section, circumferentially adjacent to the first sealing pad, such that the second section of the first flow-restriction tab overlaps the second section of the second flow-restriction tab.

Embodiments of the disclosure may further provide a method for manufacturing a plunger. The method includes machining a mandrel, such that the mandrel defines a plurality of partition walls, one or more flow-restriction recesses, one or more spring holes, and a plurality of tabs extending from the plurality of partition walls. The method also includes machining a plurality of sealing pads each defining a first section having a first circumferentially-extending edge, a second section having a second circumferentially-extending edge, and a flow-restriction tab that extends along the first and second circumferentially-extending edges. The method further includes positioning one or more springs in the one or more spring holes, and assembling the plurality of sealing pads around the mandrel, between two of the plurality of partition walls. An inner surface of each of the plurality of sealing pads engages at least one of the one or more springs and is biased outward from the mandrel. The flow-restriction tab is received into flow-restriction recess.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
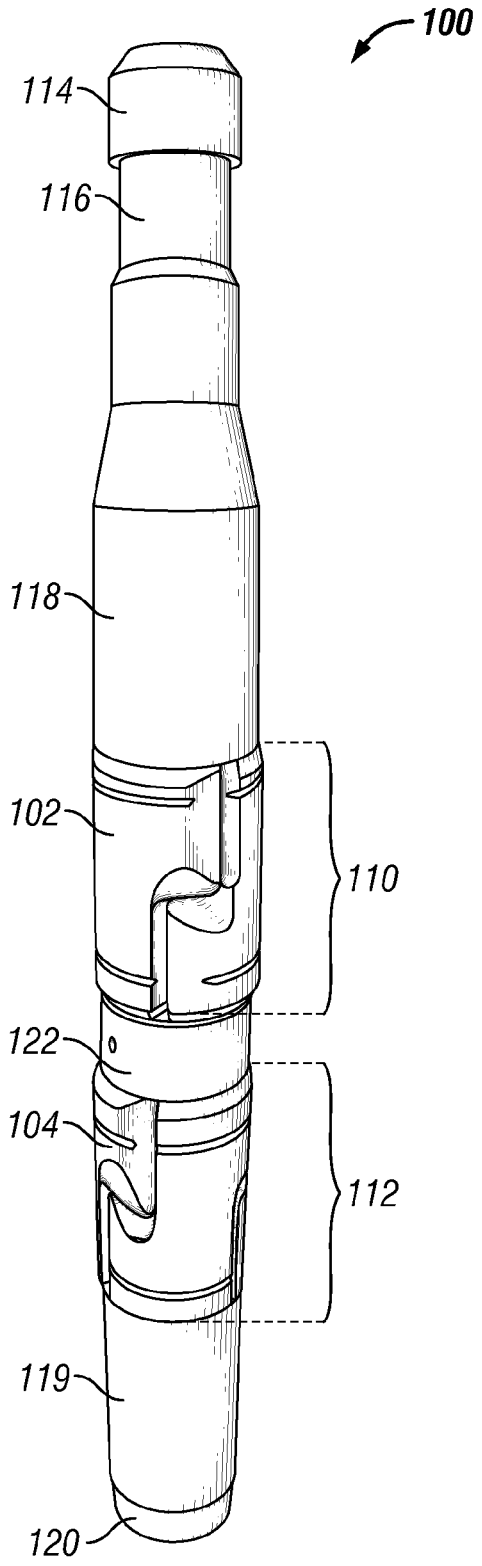
FIG. 1 illustrates a perspective view of a plunger, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a side perspective view of a downhole tool 100, according to an embodiment. The tool 100 may be configured for deployment into a wellbore, e.g., as part of an artificial lift assembly. In such an embodiment, the tool 100 may be a plunger, for example, a pad-type gas lift plunger. In other embodiments, the tool 100 may be configured for other applications in the oilfield or in other contexts.

The tool 100 may include a plurality of sealing pads 102, 104. The pads 102, 104 may be disposed in one or more rows (two are shown: 110, 112), with pads 102, 104 in the respective rows 110, 112 being circumferentially interlocked, as will be described in greater detail below. Although two rows 110, 112 are shown, it will be appreciated that a single row or three or more rows may be employed.

Furthermore, the pads 102, 104 may be biased radially-outwards, such that one, some, or all of the pads 102, 104 are configured to bear on a surrounding tubular, such as a production tubing, casing, liner, the wellbore wall itself, and/or the like. The pads 102, 104 may be shaped and configured to restrict fluid migration axially (i.e., in a direction parallel to a central axis of the tool 100) along the tool 100, e.g., between the outside surface of the pads 102, 104 and the surrounding tubular and between a radial-inside surface of the pads 102, 104 and a central mandrel, as will be discussed in greater detail below. To this end (and/or others), for example, one, some, or all of the surfaces of the pads 102, 104 may be machined, rather than (or in addition to being) cast, so as to provide a precise fit and tight seal. In various embodiments, however, the pads 102, 104 may be cast, sintered, or formed in any other way.

The tool 100 may also include a head 114 and a reduced-diameter neck 116. The head 114 and neck 116 may be configured to be engaged by a fishing tool, which may be employed to retrieve the tool 100 from the well, e.g., when the tool 100 becomes stuck in the well. The tool 100 may also include a first or "upper" collar 118, which may be disposed axially between the neck 116 and the first row 110. The upper collar 118 may be integrally formed with the neck 116 and/or head 114; however, in some embodiments, the upper collar 118, neck 116, and head 114 may be formed from two or more separate pieces, which may be coupled together, e.g., before or during assembly of the tool 100. The tool 100 may also include a second or "lower" collar 119, which may extend axially downward from the second row 112. The lower collar 119 may provide a lower guide or cap for the tool 100 and may include a beveled end 120 for guiding the tool 100 in the well. In some embodiments, the lower collar 119 may be formed from a single piece, but in other embodiments, it may be formed from two or more separate pieces.

In embodiments with two or more rows 110, 112 of pads 102, 104, the tool 100 may also include a retainer collar 122, which may be positioned axially between adjacent rows 110, 112. The retainer collar 122 may engage the pads 102, 104 of the adjacent rows 110, 112, as will be described in greater detail below. Similarly, the upper collar 118 and the lower collar 119 may engage the respective, adjacent rows 110, 112 of pads 102, 104, so as to prevent the pads 102, 104 from excessive displacement from the tool 100.

Figure 2:
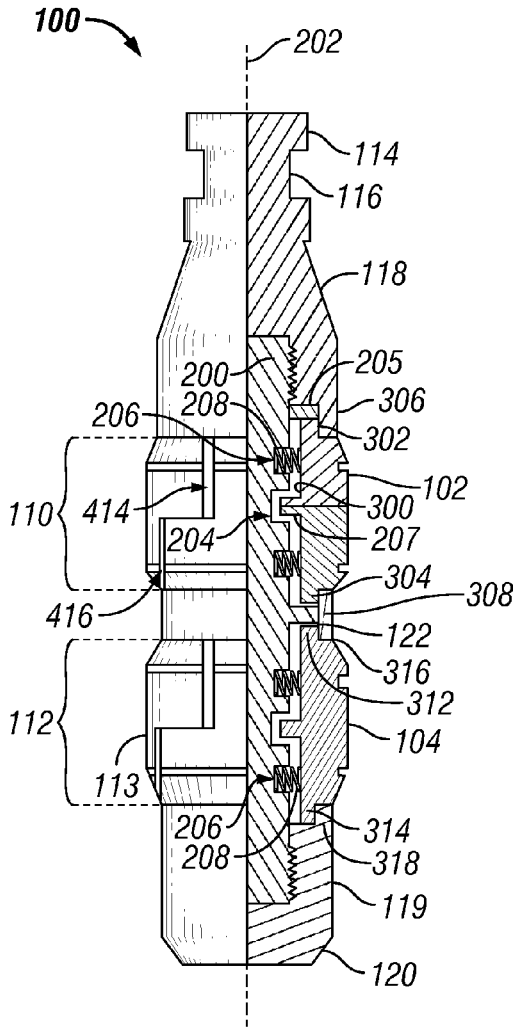
FIGS. 2 and 3 illustrate quarter-sectional views of the gas lift plunger, one rotated from the other, according to an embodiment.
Figure 3:
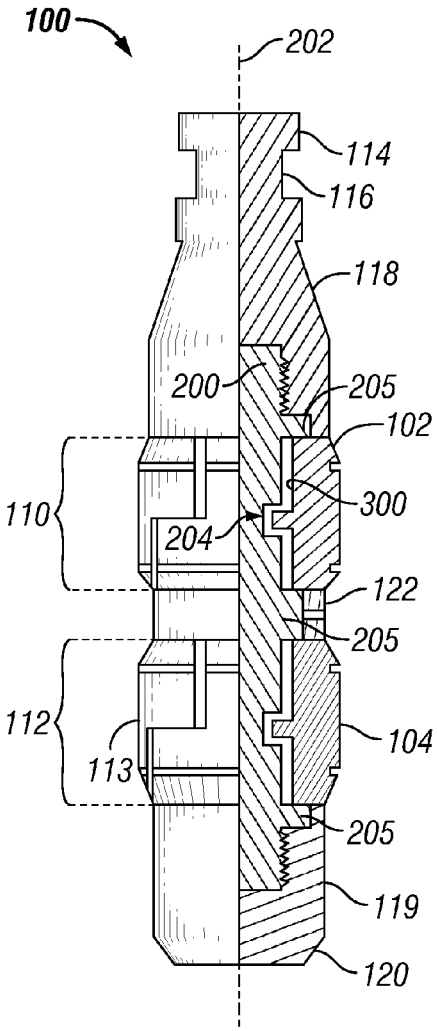

FIGS. 2 and 3 illustrate quarter-sectional views of the tool 100, according to an embodiment. More particularly, FIGS. 2 and 3 illustrate two views from different viewing angles (e.g., the section planes are rotated from one another), so that at least some circumferentially-offset features are visible in at least one of the views. It is emphasized that the illustrated embodiment represents merely an example, and that certain components and/or features may be circumferentially-offset from one another, such that they would not appear in the same cross-sectional view, notwithstanding their appearance in FIGS. 2 and/or 3.

In addition to the components mentioned above, the tool 100 may also include a mandrel 200. The mandrel 200 may define one or more flow-restriction recesses 204 therein, which may be configured to receive one or more inwardly-extending flow-restriction tabs 207 formed on the pads 102, 104. The combination of the flow-restriction recess 204 and the flow-restriction tabs 207 may serve to limit flow radially between the mandrel 200 and the pads 102, 104, as will be described in greater detail below.

The mandrel 200 may extend along a central axis 202 of the tool 100, and may, in at least some embodiments, connect with the upper and lower collars 118, 119. The mandrel 200 may connect with the upper collar 118 via a threaded connection, and may likewise connect with the lower collar 119 through such a threaded connection. In other embodiments, however, other types of connections may be formed between the mandrel 200 and the upper and/or lower collars 118, 119, such as using pins, screws, adhesive, bolts, etc. Thus, it will be appreciated that the illustrated threaded connections are merely one embodiment among many contemplated. Further, the mandrel 200 may be a unitary body, or may be constructed from two or more components that are attached together.

Figure 4:
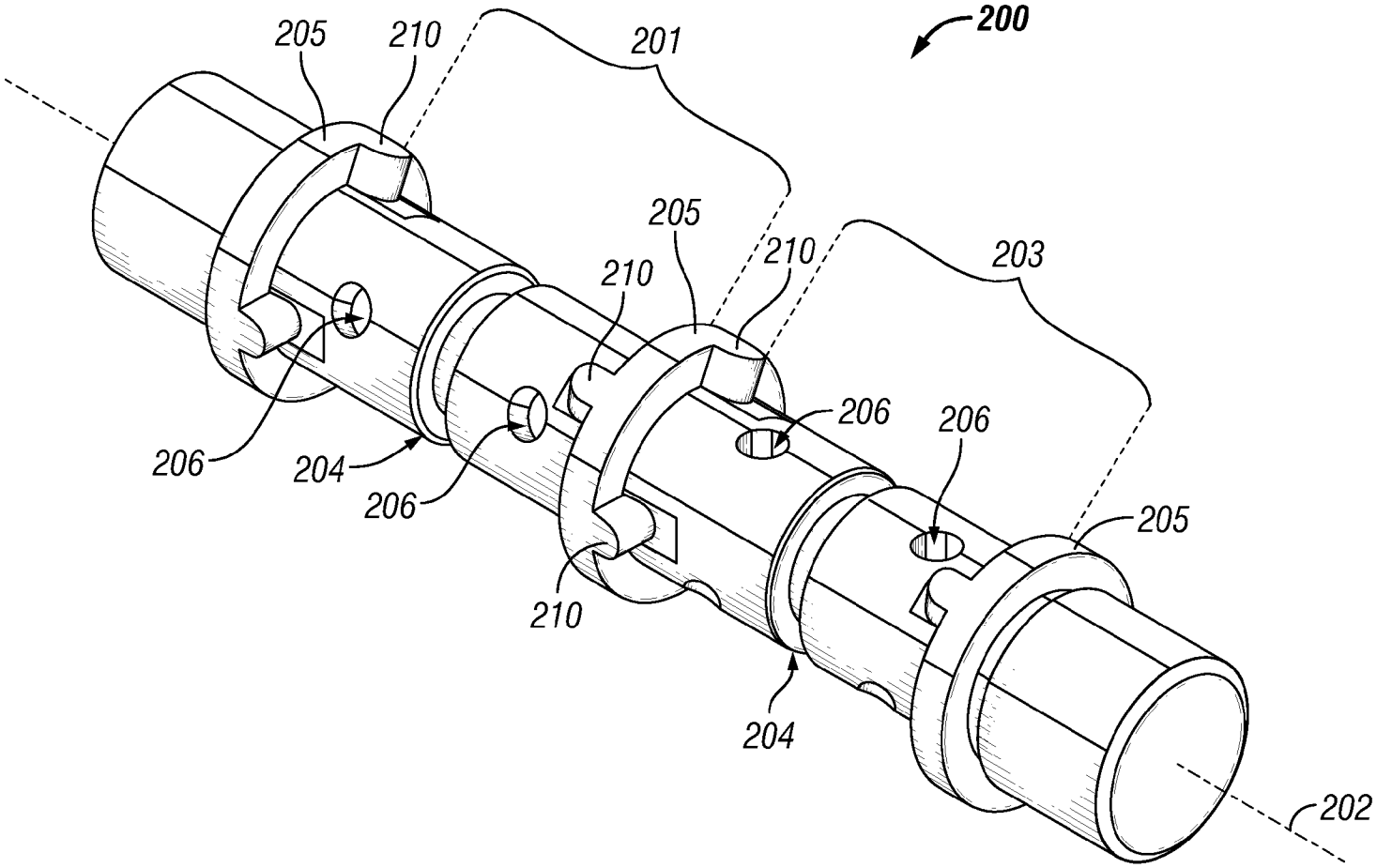
FIG. 4 illustrates a perspective view of a mandrel of the plunger, according to an embodiment.
Figure 5:
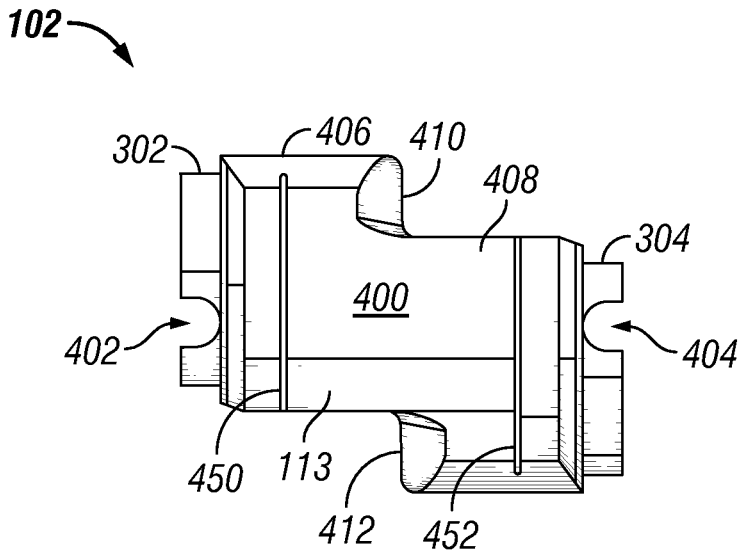
FIG. 5 illustrates a side perspective view of a sealing pad of the plunger, according to an embodiment.
Figure 6:
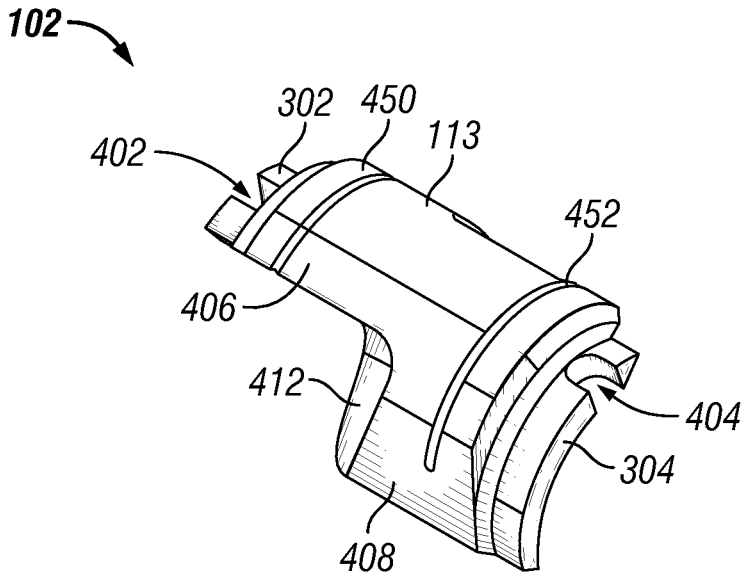
FIG. 6 illustrates a raised perspective view of the sealing pad, according to an embodiment.
Figure 7:
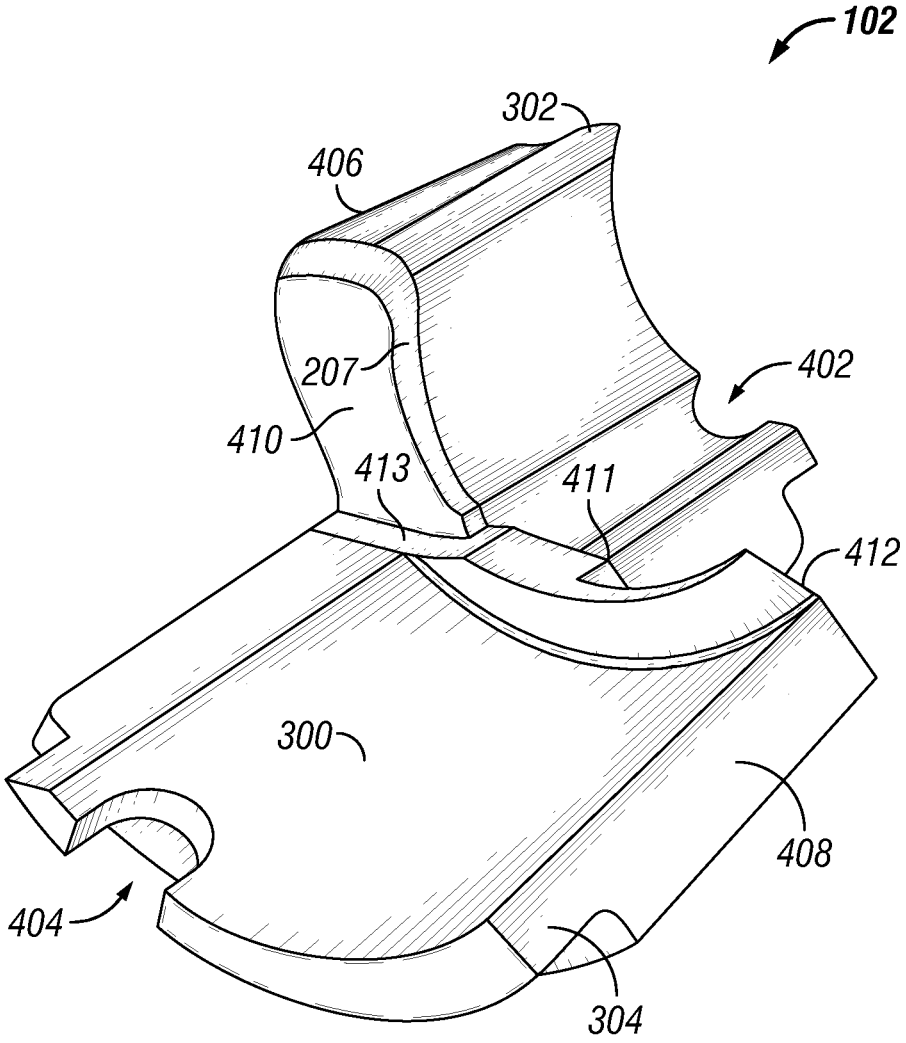
FIG. 7 illustrates a raised perspective view of the inner surface of the sealing pad, according to an embodiment.

FIG. 4 illustrates a perspective view of the mandrel 200, according to an embodiment, with a remainder of the tool 100 removed for purposes of illustration. Referring now to FIGS. 2-4, the mandrel 200 may include one or more pad-receiving sections 201, 203, which may be configured to receive the rows 110, 112 of pads 102, 104, respectively. Partition walls 205 extending radially-outward from the mandrel 200 may delimit the axial extents of the respective pad-receiving sections 201, 203. The partition walls 205 may be integral with or separate from and connected to the mandrel 200, and in either case, may be referred to as being part of the mandrel 200.

Further, the pad-receiving sections 201, 203 may define one or more flow-restriction recesses 204. In the specific, illustrated embodiment, one of the flow-restriction recesses 204 is defined for each of the pad-receiving sections 201, 203; however, in other embodiments, two or more recesses 204 may be provided for a single pad-receiving section 201, 203 and/or one or more of the pad-receiving sections 201, 203 may omit a flow-restriction recess 204.

In an embodiment, the flow-restriction recesses 204 may be positioned proximal to the axial middle of the pad-receiving sections 201, 203, and thus the pads 102, 104 of the respective rows 110, 112, but in other embodiments, may be placed elsewhere. The flow-restriction recesses 204 may extend radially-inwards, toward the central axis 202. Further, the flow-restriction recesses 204 may extend at least partially around the mandrel 200, for example, entirely therearound, such that each forms a ring-shaped recess. In other embodiments, the flow-restriction recess 204 may define other shapes.

The mandrel 200 may also include one or more spring holes 206, e.g., two for each pad 102, 104, although any other number of spring holes may be employed. The spring holes 206 may be aligned at a common circumferential position (e.g., FIG. 2), or may be circumferentially offset, e.g., as between adjacent pad-receiving sections 201, 203. Biasing members 208 (e.g., FIG. 2) may be disposed in the spring holes 206, and may act to bias the pads 102, 104 radially-outwards, e.g., into engagement with a surrounding tubular. In an embodiment, the biasing members 208 may be helical, INCONEL® springs, but in other embodiments, other types of biasing members, springs, materials, etc. may be employed.

The mandrel 200 may also include guide tabs 210 (six are visible in FIG. 4). One or more, e.g., several, guide tabs 210 may extend from each of the partition walls 205. In an embodiment, the guide tabs 210 may have an elongate, rounded profile, as shown, but in other embodiments, may have any other shape. Further, the guide tabs 210 may be aligned or circumferentially offset. For example, as shown in FIG. 4, the guide tabs 210 on each side of the pad-receiving sections 201, 203 may be circumferentially misaligned, but aligned with one or more corresponding guide tabs 210 of the adjacent pad-receiving section 201, 203. In other embodiments, all of the guide tabs 210 may be aligned (e.g., as shown in FIG. 3), or all may be misaligned, or any other alignment/misalignment configuration may be employed. In some embodiments, the guide tabs 210 may be from about 5°, about 10°, about 20° to about 30°, about 40° or about 45° circumferentially offset or "misaligned" from the spring holes 206.

The guide tabs 210 may extend axially from the partition walls 205 of the mandrel 200, e.g., in an inboard direction toward the respective flow-restriction recesses 204 of the respective pad-receiving portions 201, 203. In an embodiment, the guide tabs 210 may be integrally-formed with the partitions walls 205, which may in turn be integrally-formed with the mandrel 200. In other embodiments, one or both of the partition walls 205 and the guide tabs 210 may be formed from separate pieces that may be coupled with the mandrel 200, while still being considered a part of the mandrel 200.

Referring specifically to FIGS. 2 and 3, an outer surface 113 of the pads 102, 104 may face away from the mandrel 200, and may be configured to engage the surrounding tubular. An opposing, inner surface 300 of the respective pads 102, 104 may bear on the respective biasing members 208, pushing the pads 102, 104 radially-outwards from the mandrel 200. The pads 102, 104 may also include one or more lips. For example, each of the pads 102 of the first row 110 may include a first or "upper" lip 302 and a second or "lower" lip 304. In the illustrated example, the first lip 302 of each pad 102 may be sized and configured to be received into a complementary, overhanging lip 306 of the upper collar 118. That is, the upper lip 302 may be received radially between the mandrel 200 and the lip 306. Similarly, the lower lip 304 of each pad 102 may be received radially between a first or "upper" overhanging lip 308 of the retainer collar 122 and the mandrel 200.

The pads 104 of the second row 112 may likewise have a first or "upper" lip 312 and a second or "lower" lip 314. The upper lip 312 may be received between the mandrel 200 and a complementary, second or "lower" overhanging lip 316 of the retainer collar 122. The lower lip 314 may be received between the mandrel 200 and a complementary overhanging lip 318 of the lower collar 119.

The overhanging lips 306, 308, 316, 318 may be located a radial distance from the mandrel 200, so as to define a clearance space that is radially thicker than the thickness of the respective lips 302, 304, 312, 314 of the pads 102, 104. Accordingly, there may be a radial range of motion defined for the pads 102, 108 between the mandrel 200 and the overhanging lips 306, 308, 316, 318, with the biasing members 216-222 biasing the pads 102, 104 toward the radial-outermost position of that radial range, in at least one embodiment. However, in some embodiments, the flow-restriction tab 207 may remain at least partially received in the flow-restriction recess 204 at the radial-outermost position of the pads 102, 104. Further, it will be appreciated that the lips 302, 304, 312, 314 may or may not have the same radial thickness, and that the overhanging lips 306, 308, 316, 318 may be disposed at the same, or one or more different, radial distances from the mandrel 200 and may have the same or one or more different radial thicknesses.

The retainer collar 122 providing the overhanging lips 308, 316 may be secured to the mandrel 200. For example, the retainer collar 122 may be pinned, bolted, otherwise fastened, adhered, welded, or otherwise attached to one of the partition walls 205, e.g., the partition wall 205 disposed axially between the two pad-receiving sections 201, 203.

FIGS. 5-8 illustrate views of one of the pads 102, according to an embodiment, with it being appreciated that one, some, or all the remaining pads 102, 104 may be similar (or the same) as the pad 102 illustrated. As shown, the pad 102 has a main body 400, from which the upper and lower lips 302, 304 extend. The main body 400 may have a larger radial dimension (i.e., thickness) than the lips 302, 304. It will be appreciated, however, that the lips 302, 304 may not have the same radial thickness.

The lips 302, 304 may define guide slots 402, 404, respectively. The guide slots 402, 404 may have a radiused shape, as shown, but in other embodiments, may be square, rectangular, or any other shape. The guide slots 402, 404 may be circumferentially aligned with and complementary in shape to the guide tabs 210, and may be positioned, sized, and/or otherwise configured to receive the guide tabs 210 at least partially therein.

During assembly, the guide slots 402, 404 may thus receive the guide tabs 210, constraining the pad 102 from rotating about the central axis 202 with respect to the mandrel 200. Moreover, the lips 302, 304 may bear against the guide tabs 210 and/or the partition walls 205, so as to constrain an axial position of the pad 102 with respect to the mandrel 200. Further, with the lips 302, 304 received radially between the mandrel 200 and the overhanging lips 312, 314, the radial position of the pad 102 may be constrained.

The pad 102 may also include first and second sections 406, 408, which may have approximately the same size and/or shape, but may be circumferentially shifted with respect to one another, so as to define a generally square-"S" shape. More particularly, the first section 406 may include a "circumferential" (i.e., extending circumferentially around the central axis 202 of the mandrel 200, when the pad 102 is assembled thereon) edge 410 proximal to a middle of the body 400. Similarly, the second section 408 may include a circumferential edge 412 proximal to a middle of the body 400. The edges 410, 412 may be at least partially overlapping, and may merge together proximal a circumferential middle of the body 400.

At or proximal to the edges 410, 412, the pad 102 may define the flow-restriction tab 207 which may extend inwards from the inner surface 300 and may be received into the flow-restriction recess 204 when the pad 102 is assembled onto the mandrel 200. The flow-restriction tab 207 may extend circumferentially along the body 400, e.g., from one circumferential side to the other, continuously. In other embodiments, the flow-restriction tab 207 may extend only partially across the body 400 and/or may be segmented, may include two or more axially offset pieces, etc. In addition, in some embodiments, the tab 207 may extend in a simple arc, as shown, but in others may have a more complex shape, such as one or more corners, curves, etc., or may form any other shape.

Figure 8:
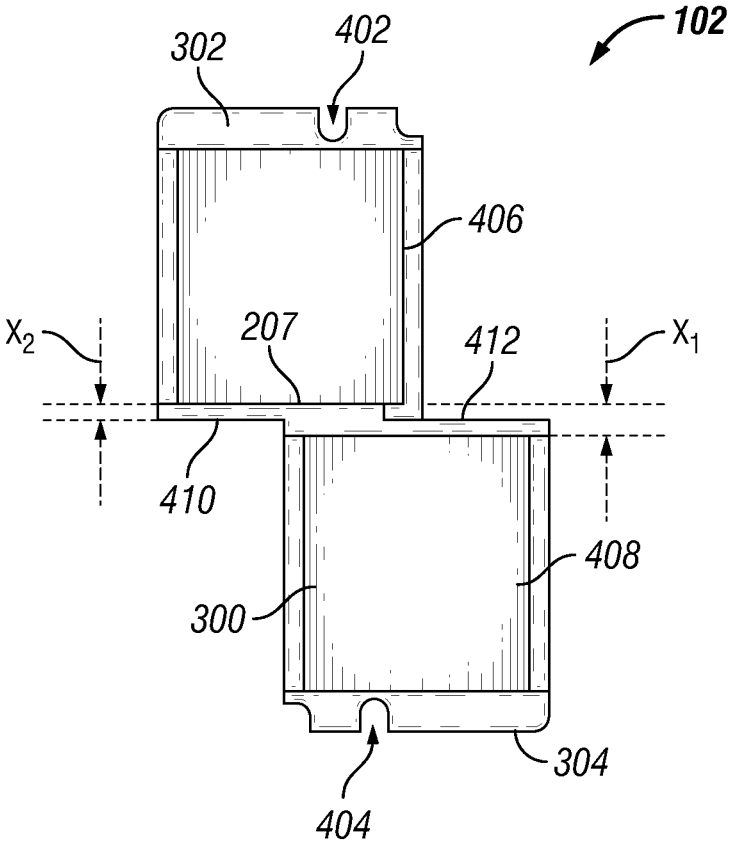
FIG. 8 illustrates a side perspective view of the inner surface of the sealing pad, according to an embodiment.

In some embodiments, the flow-restriction tab 207 may not have a uniform axial dimension (i.e., thickness). For example, as shown in FIG. 8, near the circumferential middle of the body 400, where the first and second sections 406, 408 overlap, a first portion of the tab 207 may have a first axial thickness X1. As proceeding in either circumferential direction, along the circumferentially-extending edges 410, 412, the flow-restriction tab 207 may transition to a second portion having a second axial thickness X2, which may be smaller than the first thickness X1. As such, the first portion may be circumferentially adjacent to the second portion of the flow-restriction tab 207.

The flow-restriction tab 207 may form shoulders 411, 413 at the transition from the first axial thickness X1 to the second axial thickness X2, e.g., on either circumferential side of the first portion having the first axial thickness X1. In an embodiment, the second axial thickness X2 may be about half of the first axial thickness X1. In other embodiments, the second axial thickness X2 may be different, depending on the circumferential side. Moreover, the second axial thickness X2 may be any portion of the first axial thickness X1. In an embodiment, the second sections of two adjacent pads 102, 104, when assembled or otherwise received around the mandrel 200, may be configured to overlap, such that the combination of the two second portions of the flow-restriction tab 207 equals about the first axial thickness X1 of the first portion of the flow-restriction tab 207.

In an embodiment, the first portion having the first axial thickness X1 may define from about 10%, about 15%, or about 25% to about 30%, about 40% or about 50% of the circumferential extent of the flow-restriction tab 207. Further, in an embodiment, each of the second portions having the second axial thickness X2 may define from about 10%, about 15%, or about 25% to about 30%, about 40% or about 45% of the circumferential extent of the flow-restriction tab 207.

Referring additionally to FIGS. 1-3, the pads 102, 104 in one of the rows 110, 112 may be axially aligned and circumferential adjacent, such that they are interlocked. For example, the first section 406 of one of the pads 102, 104 may be circumferentially adjacent to another one of the pads 102, 104, and the second section 408 thereof may also be circumferential adjacent. Axially-extending gaps 414 may be defined between the adjacent first sections 406, and gaps 416 may be defined between the adjacent second sections 408. These gaps 414, 416 may expand or contract in circumferential dimension depending on the radial position of the pads 102, 104 with respect to the mandrel 200, e.g., expanding as the pads 102, 104 move outward from the mandrel 200.

Still considering two adjacent pads 102, 104, the edge 410 of the first section 406 of one pad 102, 104 may be closely-proximal, e.g., touching, the edge 412 of the second section 408 of an adjacent pad 102, 104. Accordingly, the flow-restriction tab 207 of the pad 102 extending along the edge 410 may overlap the flow-restriction tab 207 of the pad 104 at the edge 412 of the second section 408. With flow-restriction tabs 207 in the overlapping areas having the second axial thickness X2, which may be a portion of the first axial thickness X1, the overlapping of the portions of the two flow-restriction tabs 207 may result in the portions of the tab 207 combining to have about the first axial thickness X1.

The overlapping flow-restriction tabs 207 of adjacent pads 102, 104 of each row 110, 112 may thus cooperate to define a generally uniform, in some embodiments, tab 207 that extends around the mandrel 200 and into one of the flow-restriction recesses 204, when the pads 102, 104 are assembled on the mandrel 200. The flow-restriction tab 207 may thus serve to interrupt fluid flow radially between the mandrel 200 and the pads 102, 104. Furthermore, the close proximity and/or engagement between the circumferentially-extending edges 410, 412 may reduce flow between the first section 406 of one pad 102, 104 and the second section 408 of an adjacent pad 102, 104 may reduce a flow-path area for the fluid to enter or exit the area radially between the mandrel 200 and the pads 102, 104. In addition, machining the pads 102, 104 may result in a tighter fit between the pads 102, 104 and the mandrel 200 and/or between the pads 102, 104 and the surrounding tubular.

Furthermore, the tool 100 may be assembled such that any fluid flow along the central axis 202 may be required to turn, i.e., straight axial flowpaths may be avoided. This may be provided in several ways. The overlapping sections 406, 408 of the pads 102, 104 may define an S-shaped flowpath in the gaps 414, 416 and between the edges 410, 412. Further, the gaps 414, 416 of the first row 110 may be circumferentially offset from the gaps 414, 416 of the second row 112. In addition, the flow-restriction tabs 207, received into the flow-restriction recesses 204, may allow for a small fluid flowpath therebetween, but may force the flow between the pads 102, 104 and the mandrel 200 to turn radially-inward, into the flow-restriction recesses 204, proceed past the flow-restriction tab 207, and then turn radially-outward, to exit the flow-restriction recess 204. Thus, a minimal flow may be achieved.

Referring again to FIGS. 2, 3, 5 and 6, the body 400 of the pad 102 may also optionally define one or more wear indicators (two are shown: 450, 452). The wear indicators 450, 452 may be formed as recesses, in any suitable shape, cut into the outer surface 113 of the pad 102. As the pad 102 is used, the outer surface 113 may be worn down, resulting a shallower wear indicator 450, 452, until, e.g., the outer surface 113 is worn down to the bottom of the wear indicator 450, 452.

Referring to FIGS. 1-8, in an example of operation, the tool 100 may be deployed into a well tubular. The pads 102, 104 may be compressed against the biasing members 208, with a reactionary force being applied radially-outwards by the biasing members 208 on the pads 102, 104, such that the pads 102, 104 engage the tubular. The tool 100 may then slowly descend in the well, with a minimal flowpath for displaced fluid travelling between the pads 102, 104 and the tubular and/or between the pads 102, 104 and the mandrel 200.

Upon reaching a lower bumper assembly (or any other feature representing the end of the travel path for the tool 100), the seal formed between the surrounding tubular and the tool 100 may enable fluid pressure to build below the tool 100. A pressure valve may then be released, allowing the tool 100 to ascend in the well, with the pads 102, 104 remaining engaged with the tubular. As such, gas above the tool 100 may be pushed upwards in the well, toward the wellhead.

Figure 9:
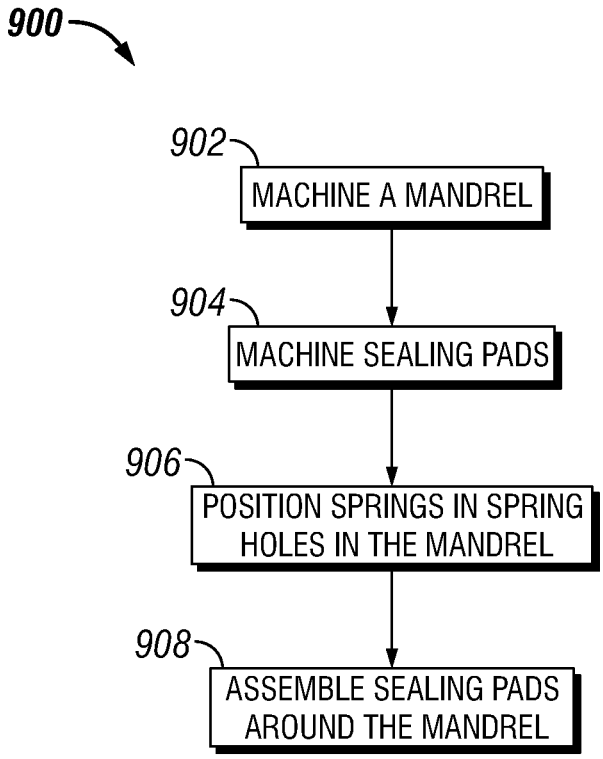
FIG. 9 illustrates a flowchart of a method for manufacturing a plunger, according to an embodiment.

FIG. 9 illustrates a flowchart of a method 900 for manufacturing a plunger, according to an embodiment. Although described herein with reference to the tool 100 described above, it will be appreciated that at least some embodiments of the method 900 may not be limited to any particular structure. In an embodiment, the method 900 may include machining the mandrel 200, as at 902. In an embodiment, the machining at 902 may be conducted such that the mandrel 200 defines (e.g., includes, whether integrally or via attachment with a separate piece) the partition walls 205, the one or more flow-restriction recesses 204, the one or more spring holes 206, and the plurality of tabs 210 extending from the plurality of partition walls 205.

The method 900 may also include machining the sealing pads 102, 104, as at 904. For example, the machining at 904 may be conducted such that each of the sealing pads 102, 104 may define the first section 406 having the first circumferentially-extending edge 410, the second section 408 having the second circumferentially-extending edge 412, and the radially-inwardly extending flow-restriction tab 207 that extends along the first and second circumferentially-extending edges 410, 412.

In an embodiment, machining the sealing pads at 904 may include, for each of the sealing pads 102, 104, defining the first thickness X1 for the flow-restriction tab 207 and the second thickness X2 for the flow-restriction tab 207. In an embodiment, the first thickness X1 may be larger than the second thickness X2.

The method 900 may also include positioning the one or more biasing members (e.g., springs) 208 in the one or more spring holes 206, as at 906. Further, the method 900 may include assembling the sealing pads 102, 104 around the mandrel 200, between (e.g., axially) two of the partition walls 205, as at 908. Further, the inner surface 300 of each of the sealing pads 102, 104 may engage at least one of the one or more biasing members 208 and is biased outward from the mandrel 200. Further, the flow-restriction tab 207 may be received into flow-restriction recess.

Moreover, in at least one embodiment, assembling the sealing pads 102, 104 around the mandrel 200 may include engaging the first circumferentially-extending edge 406 of a first one of the sealing pads 102, 104 with the second circumferentially-extending edge 410 of a second (e.g., adjacent) one of the sealing pads 102, 104, such that the flow-restriction tab 207 of the first one of the sealing pads 102, 104 overlaps the flow-restriction tab 207 of the second one of the sealing pads 102, 104. In an embodiment, the overlapping of the two portions with the first thickness X1 may result in a combined thickness approximately equal to the first thickness X1.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A downhole tool, comprising:

a mandrel comprising a flow-restriction recess; and a plurality of sealing pads configured to be disposed around the mandrel, biased radially-outward therefrom, and interlocked with one another, wherein each of the plurality of sealing pads comprises a flow-restriction tab having an axial thickness that varies as proceeding circumferentially around the mandrel when the plurality of sealing pads are disposed around the mandrel, wherein the flow-restriction tab of each of the plurality of sealing pads is configured to be disposed in the flow-restriction recess when the plurality of sealing pads are disposed on the mandrel, wherein a portion of the flow-restriction tab of a first pad of the plurality of sealing pads axially overlaps a portion of the flow-restriction tab of a second pad of the plurality of sealing pads, and wherein the axially-overlapping portions of the flow-restriction tabs of the first and second pads extend together into the flow-restriction recess when the plurality of sealing pads are disposed on the mandrel.

2. The downhole tool of claim 1, wherein the flow-restriction tab extends radially-inward from an inner surface of each of the plurality of sealing pads.

3. The downhole tool of claim 1, wherein each of the plurality of sealing pads comprises a first section and a second section, the first section defining a first circumferentially-extending edge, and the second section defining a second circumferentially-extending edge, and wherein the first circumferentially-extending edge of a first one of the plurality of sealing pads engages the second circumferentially-extending edge of a second one of the plurality of sealing pads when the plurality of sealing pads are received around the mandrel.

4. The downhole tool of claim 3, wherein the first section of the first one of the plurality of sealing pads is spaced circumferentially apart from the first section of the second one of the plurality of sealing pads, such that an axially-extending gap is defined therebetween.

5. The downhole tool of claim 4, wherein the flow-restriction tab is defined at least partially along the first and second circumferentially-extending edges.

6. The downhole tool of claim 1, further comprising a first collar coupled with the mandrel and comprising a first overhanging lip, wherein each of the plurality of sealing pads comprises a first lip that is configured to be disposed radially between the mandrel and the first overhanging lip of the first collar.

7. The downhole tool of claim 6, further comprising a retainer collar coupled with the mandrel and comprising a second overhanging lip, wherein each of the plurality of sealing pads comprises a second tab configured to be received radially between the mandrel and the second overhanging lip.

8. The downhole tool of claim 6, wherein the mandrel comprises a partition wall that extends radially-outward and a plurality of guide tabs, and wherein the first lip of each of the plurality of sealing pads comprises a guide slot that is configured to receive the plurality of guide tabs.

9. The downhole tool of claim 8, further comprising a plurality of biasing members, wherein the mandrel further comprises a plurality of holes configured to receive the plurality of biasing members, for biasing the plurality of sealing pads radially-outward from the mandrel.

10. The downhole tool of claim 9, wherein the plurality of holes are circumferentially offset from the plurality of guide tabs.

11. A plunger, comprising:

a mandrel comprising first and second annular partition walls, the first and second partition walls being spaced axially apart such that a first pad-receiving section is defined therebetween, wherein a first flow-restriction recess is defined in the mandrel at the pad-receiving section, the first flow-restriction recess extending at least partially around the mandrel;

a first sealing pad comprising a first flow-restriction tab, the first flow-restriction tab having a first portion defining a first axial thickness and a second portion defining a second axial thickness, the first axial thickness being greater than the second axial thickness, and the first portion being circumferentially adjacent to the second portion, wherein the first sealing pad is configured to be disposed in the first pad-receiving section; and a second sealing pad comprising a second flow-restriction tab, the second flow-restriction tab having a first portion defining a first axial thickness and a second portion defining a second axial thickness, the first axial thickness of the second flow-restriction tab being greater than the second axial thickness thereof, and the first portion of second flow-restriction tab being circumferentially adjacent to the second portion of the second flow-restriction tab, wherein the second sealing pad is configured to be disposed in the first pad-receiving section, circumferentially adjacent to the first sealing pad, such that the second portion of the first flow-restriction tab axially overlaps the second portion of the second flow-restriction tab, and wherein the second portion of the first flow-restriction tab and the second portion of the second flow-restriction tab extend together into the first flow-restriction recess.

12. The plunger of claim 11, wherein the second portion of the flow-restriction tab of the first pad contacts the second portion of the flow-restriction tab of the second pad.

13. The plunger of claim 11, wherein the first pad comprises a first section defining a first circumferentially-extending edge and a section defining a second circumferentially-extending edge, wherein the first and second sections overlap, and wherein the flow-restriction tab of the first pad is defined along the first circumferentially-extending edge, the second circumferentially-extending edge, and across where the first and second sections overlap.

14. The plunger of claim 13, wherein the first portion of the flow-restriction tab of the first sealing pad is defined along the first circumferentially-extending edge, and the second portion of the flow-restriction tab of the first sealing pad is defined where the first and second sections of the first sealing pad overlap.

15. The plunger of claim 11, further comprising one or more first springs disposed between the mandrel and the first sealing pad, to bias the first sealing pad outwards from the mandrel, and one or more second springs disposed between the mandrel and the second sealing pad, to bias the second sealing pad outwards from the mandrel.

16. The plunger of claim 11, further comprising:

a first collar coupled with the mandrel and comprising a first overhanging lip that is spaced radially apart from the mandrel and extends axially into the first pad-receiving section; and a second collar coupled with the mandrel and spaced axially apart from the first collar, wherein the second collar comprises a second overhanging lip that is spaced radially apart from the mandrel and extends axially into the first pad-receiving section, wherein the first pad comprises a first lip configured to be movably disposed between the mandrel and the first overhanging lip and a second lip configured to be movably disposed between the mandrel and the second overhanging lip.

17. The plunger of claim 16, wherein the mandrel further comprises first tabs extending from the first partition wall and into the first pad-receiving section and second tabs extending from the second partition wall and into the first pad-receiving section, and wherein the first lip comprises a first guide slot configured to receive one of the first tabs and the second lip comprises a second guide slot configured to receive one of the second tabs.

18. A method for manufacturing a plunger, comprising:

machining a mandrel, such that the mandrel defines a plurality of partition walls, one or more flow-restriction recesses, one or more spring holes, and a plurality of tabs extending from the plurality of partition walls;

machining a plurality of sealing pads each defining a first section having a first circumferentially-extending edge, a section having a second circumferentially-extending edge, and a flow-restriction tab that extends along the first and second circumferentially-extending edges;

positioning one or more springs in the one or more spring holes; and assembling the plurality of sealing pads around the mandrel, between two of the plurality of partition walls, wherein an inner surface of each of the plurality of sealing pads engages at least one of the one or more springs and is biased outward from the mandrel, wherein the flow-restriction tab is received into flow-restriction recess, and wherein the flow-restriction tabs of adjacent ones of the plurality of sealing pads are axially overlapping and extend together into at least one of the one or more the flow-restriction recesses.

19. The method of claim 18, wherein machining the plurality of sealing pads comprises, for each of the plurality of sealing pads, defining a first thickness for the flow-restriction tab and a second thickness for the flow-restriction tab, the first thickness being larger than the second thickness.

20. The method of claim 19, wherein assembling the plurality of sealing pads around the mandrel comprises engaging the first circumferentially-extending edge of a first one of the plurality of sealing pads with the second circumferentially-extending edge of a second one of the plurality of sealing pads, such that the flow-restriction tab of the first one of the plurality of sealing pads overlaps the flow-restriction tab of the second one of the plurality of sealing pads.

* * * * *